US008469655B2

(12) United States Patent
Gammack

(10) Patent No.: US 8,469,655 B2
(45) **Date of Patent: *Jun. 25, 2013**

(54) FAN ASSEMBLY

(75) Inventor: Peter David Gammack, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/284,516

(22) Filed: Oct. 28, 2011

(65) Prior Publication Data

US 2012/0045315 A1 Feb. 23, 2012

Related U.S. Application Data

(63) Continuation of application No. 12/716,613, filed on Mar. 3, 2010, now Pat. No. 8,052,379.

(30) Foreign Application Priority Data

Mar. 4, 2009 (GB) ..... 0903674.0

(51) Int. Cl.
*F04D 29/62* (2006.01)

(52) U.S. Cl.
USPC ..... 415/126

(58) Field of Classification Search
USPC ..... 415/51, 119, 126, 127; 416/9, 13, 416/16, 117, 118, 119
See application file for complete search history.

(56) References Cited

U.S. PATENT DOCUMENTS

| | | | |
|---|---|---|---|
| 1,357,261 | A | 11/1920 | Svoboda |
| 1,767,060 | A | 6/1930 | Ferguson |
| 1,896,869 | A | 2/1933 | Larsh |
| 2,014,185 | A | 9/1935 | Martin |
| 2,035,733 | A | 3/1936 | Wall |
| D103,476 | S | 3/1937 | Weber |
| 2,115,883 | A | 5/1938 | Sher |
| D115,344 | S | 6/1939 | Chapman |
| 2,210,458 | A | 8/1940 | Keilholtz |
| 2,258,961 | A | 10/1941 | Saathoff |
| 2,336,295 | A | 12/1943 | Reimuller |
| 2,433,795 | A | 12/1947 | Stokes |

(Continued)

FOREIGN PATENT DOCUMENTS

| | | |
|---|---|---|
| BE | 560119 | 8/1957 |
| CA | 1055344 | 5/1979 |

(Continued)

OTHER PUBLICATIONS

GB Search Report dated Jun. 24, 2009, directed to GB Application No. 0903674.0; 2 pages.

(Continued)

*Primary Examiner* — Igor Kershteyn
(74) *Attorney, Agent, or Firm* — Morrison & Foerster LLP

(57) ABSTRACT

A fan assembly for creating an air current includes an air outlet mounted on a stand. The stand includes a base and a body tiltable relative to the base. The fan assembly has a center of gravity located so that when the base is located on a substantially horizontal support surface, the projection of the center of gravity on the support surface is within the footprint of the base when the body is in a fully tilted position.

11 Claims, 9 Drawing Sheets

U.S. PATENT DOCUMENTS 2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger, IV
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,395,087 A * 3/1995 VanBasten ..... 248/397
5,402,938 A 4/1995 Sweeney
5,407,324 A 4/1995 Starnes, Jr. et al.
5,425,902 A 6/1995 Miller et al.
5,518,370 A 5/1996 Wang et al.
5,609,473 A 3/1997 Litvin
5,645,769 A 7/1997 Tamaru et al.
5,649,370 A 7/1997 Russo
5,720,594 A * 2/1998 Snow ..... 416/100
5,735,683 A 4/1998 Muschelknautz
5,762,034 A 6/1998 Foss
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,244,823 B1 * 6/2001 Marino et al. ..... 416/246
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
D485,895 S 1/2004 Melwani
6,789,787 B2 9/2004 Stutts
6,830,433 B2 12/2004 Birdsell et al.
6,932,579 B2 * 8/2005 Cichetti et al. ..... 416/246
7,059,826 B2 6/2006 Lasko
7,088,913 B1 8/2006 Verhoorn et al.
7,147,336 B1 12/2006 Chou
D539,414 S 3/2007 Russak et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 2/2010 Liao
D614,280 S 4/2010 Dyson et al.
7,775,848 B1 8/2010 Auerbach
7,806,388 B2 10/2010 Junkel et al.
8,092,166 B2 1/2012 Nicolas et al.
2002/0106547 A1 8/2002 Sugawara et al.
2003/0059307 A1 3/2003 Moreno et al.
2003/0171093 A1 9/2003 Gumucio Del Pozo
2004/0022631 A1 2/2004 Birdsell et al.
2004/0049842 A1 3/2004 Prehodka
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.
2005/0173997 A1 8/2005 Schmid et al.
2005/0281672 A1 12/2005 Parker et al.
2006/0172682 A1 8/2006 Orr et al.
2006/0199515 A1 9/2006 Lasko et al.
2007/0035189 A1 2/2007 Matsumoto
2007/0041857 A1 2/2007 Fleig
2007/0065280 A1 3/2007 Fok
2007/0166160 A1 7/2007 Russak et al.
2007/0176502 A1 8/2007 Kasai et al.
2007/0224044 A1 9/2007 Hong et al.
2007/0269323 A1 11/2007 Zhou et al.
2008/0020698 A1 1/2008 Spaggiari
2008/0152482 A1 6/2008 Patel
2008/0166224 A1 7/2008 Giffin
2008/0286130 A1 11/2008 Purvines
2008/0314250 A1 12/2008 Cowie et al.
2009/0026850 A1 1/2009 Fu
2009/0039805 A1 2/2009 Tang
2009/0060710 A1 3/2009 Gammack et al.
2009/0060711 A1 3/2009 Gammack et al.
2009/0191054 A1 7/2009 Winkler
2009/0214341 A1 8/2009 Craig
2010/0150699 A1 6/2010 Nicolas et al.
2010/0162011 A1 6/2010 Min
2010/0171465 A1 7/2010 Seal et al.
2010/0225012 A1 9/2010 Fitton et al.
2010/0226749 A1 9/2010 Gammack et al.
2010/0226750 A1 9/2010 Gammack
2010/0226751 A1 9/2010 Gammack et al.
2010/0226752 A1 9/2010 Gammack et al.

| | | | |
|---|---|---|---|
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201180678 | 1/2009 |
| CN | 201221477 | 4/2009 |
| CN | 201281416 | 7/2009 |
| CN | 201349269 | 11/2009 |
| CN | 101749288 | 6/2010 |
| CN | 201502549 | 6/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102367813 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| EP | 0 044 494 | 1/1982 |
| EP | 0186581 | 7/1986 |
| EP | 1 094 224 | 4/2001 |
| EP | 1 138 954 | 10/2001 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1387334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2 463 698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-60100 | 5/1978 |
| JP | 56-167897 | 12/1981 |
| JP | 57-71000 | 5/1982 |
| JP | 57-157097 | 9/1982 |
| JP | 61-31830 | 2/1986 |
| JP | 61-116093 | 6/1986 |
| JP | 61-280787 | 12/1986 |
| JP | 62-223494 | 10/1987 |
| JP | 63-179198 | 7/1988 |
| JP | 63-306340 | 12/1988 |
| JP | 64-21300 U | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-52515 | 5/1991 |
| JP | 3-267598 | 11/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |

| | | |
|---|---|---|
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 8-21400 | 1/1996 |
| JP | 9-100800 | 4/1997 |
| JP | 9-287600 | 11/1997 |
| JP | 10-65999 | 3/1998 |
| JP | 11-227866 | 8/1999 |
| JP | 2000-116179 | 4/2000 |
| JP | 2000-201723 | 7/2000 |
| JP | 2001-17358 | 1/2001 |
| JP | 2002-21797 | 1/2002 |
| JP | 2002-138829 | 5/2002 |
| JP | 2002-213388 | 7/2002 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2010-131259 | 6/2010 |
| KR | 10-2005-0102317 | 10/2005 |
| KR | 10-0576107 | 4/2006 |
| KR | 2007-0007997 | 1/2007 |
| KR | 10-2010-0055611 | 5/2010 |
| KR | 10-0985378 | 9/2010 |
| TW | M394383 | 12/2010 |
| TW | M407299 | 7/2011 |
| WO | WO 90/13478 | 11/1990 |
| WO | WO-02/073096 | 9/2002 |
| WO | WO 03/058795 | 7/2003 |
| WO | WO-03/069931 | 8/2003 |
| WO | WO-2005/050026 | 6/2005 |
| WO | WO 2005/057091 | 6/2005 |
| WO | WO-2006/008021 | 1/2006 |
| WO | WO-2006/012526 | 2/2006 |
| WO | WO 2007/024955 | 3/2007 |
| WO | WO 2007/048205 | 5/2007 |
| WO | WO 2008/014641 | 2/2008 |
| WO | WO-2008/024569 | 2/2008 |
| WO | WO-2009/030879 | 3/2009 |
| WO | WO-2009/030881 | 3/2009 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |

OTHER PUBLICATIONS

International Search Report and Written Opinion mailed May 18, 2010, directed to counterpart International Application No. PCT/GB2010/050268; 10 pages.
Reba, I., (Jun. 1966). "Applications of the Coanda Effect." Scientific American.214:84-92.
Gammack et al., U.S. Appl. No. 12/945,558, filed Nov. 12, 2010; 23 pages.
Gammack et al., U.S. Appl. No. 12/917,247, filed Nov. 1, 2010; 40 pages.
Gammack, P. et al., U.S. Office Action mailed Dec. 9, 2010, directed to U.S. Appl. No. 12/203,698; 10 pages.
Gammack, P. et al., U.S. Office Action mailed Dec. 10, 2010, directed to U.S. Appl. No. 12/230,613; 12 pages.
Fitton et al., U.S. Office Action mailed Nov. 30, 2010 directed to U.S. Appl. No. 12/560,232; 9 pafes.
Gammack, P. et al., U.S. Office Action mailed Dec. 9, 2010, directed to U.S. Appl. No. 12/716,781; 17 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack P. et al., U.S. Office Action mailed May 24, 2011, directed to U.S. Appl. No. 12/716,613; 9 pages.
GB Search Report dated Apr. 11, 2011 directed towards related application No. GB1021094.6; 2 pages.
GB Search Report dated Apr. 11, 2011 directed towards related application No. GB1021093.8; 2 pages.
GB Search Report dated Apr. 11, 2011 directed towards related application No. GB1021092.0; 2 pages.
Gammack, P. et al., U.S. Office Action mailed Jun. 8, 2012, directed to U.S. Appl. No. 12/230,613; 15 pages.
Gammack, P. et al., U.S. Office Action mailed Jun. 25, 2012, directed to U.S. Appl. No. 12/716,749; 11 pages.
Gammack et al., Office Action mailed Sep. 17, 2012, directed to U.S. Appl. No. 13/114,707; 12 pages.
Gammack et al., U.S. Office Action mailed Aug. 20, 2012, directed to U.S. Appl. No. 12/945,558; 15 pages.
Fitton et al., U.S. Office Action mailed Mar. 30, 2012, directed to U.S. Appl. No. 12/716,707; 7 pages.
Gammack, P. et al., U.S. Office Action mailed Jun. 21, 2011, directed to U.S. Appl. No. 12/203,698; 11 pages.
Gammack, P. et al., U.S. Office Action mailed May 13, 2011, directed to U.S. Appl. No. 12/230,613; 13 pages.
Gammack, P. et al., U.S. Office Action mailed Sep. 7, 2011, directed to U.S. Appl. No. 12/230,613; 15 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Final Office Action mailed Jun. 24, 2011, directed to U.S. Appl. No. 12/716,781; 19 pages.
Third Party Submission Under 37 CFR 1.99 filed Jun. 2, 2011, directed towards U.S. Appl. No. 12/203,698; 3 pages.
Gammack, P. et al. U.S. Office Action mailed Nov. 2, 2012, directed to U.S. Appl. No. 13/314,974; 8 pages.
Gammack, P. et al., U.S. Office Action mailed Jan. 7, 2013, directed to U.S. Appl. No. 12/716,749; 16 pages.

* cited by examiner (a)

B-B
(c)

A-A
(b)

FAN ASSEMBLY

REFERENCE TO RELATED APPLICATIONS

This application is a continuation of U.S. patent application Ser. No. 12/716,613, filed Mar. 3, 2010, which claims the priority of United Kingdom Application No. 0903674.0, filed 4 Mar. 2009, the entire contents of which are incorporated herein by reference.

FIELD OF THE INVENTION

The present invention relates to a fan assembly. Particularly, but not exclusively, the present invention relates to a domestic fan, such as a desk fan, for creating air circulation and air current in a room, in an office or other domestic environment.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation.

Such fans are available in a variety of sizes and shapes. For example, a ceiling fan can be at least 1 m in diameter, and is usually mounted in a suspended manner from the ceiling to provide a downward flow of air to cool a room. On the other hand, desk fans are often around 30 cm in diameter, and are usually free standing and portable. Other types of fan can be attached to the floor or mounted on a wall. Fans such as that disclosed in USD 103,476 and U.S. Pat. No. 1,767,060 are suitable for standing on a desk or a table.

A disadvantage of this type of fan is that the air flow produced by the rotating blades is generally not uniform. This is due to variations across the blade surface or across the outward facing surface of the fan. The extent of these variations can vary from product to product and even from one individual fan machine to another. These variations result in the generation of an uneven or 'choppy' air flow which can be felt as a series of pulses of air and which can be uncomfortable for a user. A further disadvantage is that the cooling effect created by the fan diminishes with distance from the user. This means that the fan must be placed in close proximity to the user in order for the user to experience the cooling effect of the fan.

An oscillating mechanism may be employed to rotate the outlet from the fan so that the air flow is swept over a wide area of a room. The oscillating mechanism can lead to some improvement in the quality and uniformity of the air flow felt by a user although the characteristic 'choppy' air flow remains.

Locating fans such as those described above close to a user is not always possible as the bulky shape and structure of the fan mean that the fan occupies a significant amount of the user's work space area.

Some fans, such as that described in U.S. Pat. No. 5,609,473, provide a user with an option to adjust the direction in which air is emitted from the fan. In U.S. Pat. No. 5,609,473, the fan comprises a base and a pair of yokes each upstanding from a respective end of the base. The outer body of the fan houses a motor and a set of rotating blades. The outer body is secured to the yokes so as to be pivotable relative to the base. The fan body may be swung relative to the base from a generally vertical, untilted position to an inclined, tilted position. In this way the direction of the air flow emitted from the fan can be altered.

In such fans, a securing mechanism may be employed to fix the position of the body of the fan relative to the base. The securing mechanism may comprise a clamp or manual locking screws which may be difficult to use, particularly for the elderly or for users with impaired dexterity.

In a domestic environment it is desirable for appliances to be as small and compact as possible due to space restrictions. In contrast, fan adjustment mechanisms are often bulky, and are mounted to, and often extend from, the outer surface of the fan assembly. When such a fan is placed on a desk, the footprint of the adjustment mechanism can undesirably reduce the area available for paperwork, a computer or other office equipment. In addition, it is undesirable for parts of the appliance to project outwardly, both for safety reasons and because such parts can be difficult to clean.

SUMMARY OF THE INVENTION

In a first aspect the present invention provides a fan assembly for creating an air current, the fan assembly comprising a stand and an air outlet mounted on the stand for emitting an air flow, the stand comprising a base and a body tiltable relative to the base from an untilted position to a tilted position, the body comprising a system for creating said air flow, the fan assembly having a center of gravity located so that when the base is located on a substantially horizontal support surface, the projection of the center of gravity on the support surface is within the footprint of the base when the body is in a fully tilted position.

The weight of the components of the system for creating said air flow can act to stabilize the body on the base when the body is in a tilted position. The center of gravity of the fan assembly is preferably located within the body. Preferably the system for creating said air flow comprises an impeller, a motor for rotating the impeller, and preferably also a diffuser located downstream from the impeller. The impeller is preferably a mixed flow impeller. The motor is preferably a DC brushless motor to avoid frictional losses and carbon debris from the brushes used in a traditional brushed motor. Reducing carbon debris and emissions is advantageous in a clean or pollutant sensitive environment such as a hospital or around those with allergies. While induction motors, which are generally used in pedestal fans, also have no brushes, a DC brushless motor can provide a much wider range of operating speeds than an induction motor.

The body preferably comprises at least one air inlet through which air is drawn into the fan assembly by the system for creating said air flow. This can provide a short, compact air flow path that minimizes noise and frictional losses.

The projection of the center of gravity on the support surface may be behind the center of the base with respect to a forward direction of the fan assembly when the body is in an untilted position.

Each of the base and the body preferably has an outer surface shaped so that adjoining portions of the outer surfaces are substantially flush when the body is in the untilted position. This can provide the stand with a tidy and uniform appearance when in an untilted position. This type of uncluttered appearance is desirable and often appeals to a user or customer. The flush portions also have the benefit of allowing the outer surfaces of the base and the body to be quickly and easily wiped clean. The outer surfaces of the base and the body are preferably substantially cylindrical. In the preferred embodiment the stand is substantially cylindrical.

Preferably the base has a substantially circular footprint having a radius r, and a longitudinal axis passing centrally therethrough. Preferably the center of gravity of the fan assembly is spaced by a radial distance of no more than 0.8 r, more preferably no more than 0.6 r and preferably no more than 0.4 r, from the longitudinal axis when the body is in a fully tilted position. This can provide the fan assembly with increased stability.

Preferably, the base comprising a plurality of rolling elements for supporting the body, the body comprising a plurality of curved races for receiving the rolling elements and within which the rolling elements move as the body is moved from an untilted position to a tilted position. The curved races of the body are preferably convex in shape. Preferably the base comprises a plurality of support members each comprising a respective one of the rolling elements. The support surfaces preferably protrude from a curved, preferably concave, surface of the base of the stand.

The stand preferably comprises interlocking members for retaining the body on the base. The interlocking members are preferably enclosed by the outer surfaces of the base and the body when the body is in the untilted position so that the stand retains its tidy and uniform appearance.

The stand preferably comprises at least one biasing member for urging the interlocking members together to resist movement of the body from the tilted position. The base preferably comprises a plurality of support members for supporting the body, and which are preferably also enclosed by the outer surfaces of the base and the body when the body is in the untilted position. Each support member preferably comprises a rolling element for supporting the body, the body comprising a plurality of curved races for receiving the rolling elements and within which the rolling elements move as the body is moved from an untilted position to a tilted position.

The interlocking members preferably comprise a first plurality of locking members located on the base, and a second plurality of locking members located on the body and which are retained by the first plurality of locking members. Each of the locking members is preferably substantially L-shaped. The interlocking members preferably comprise interlocking flanges, which are preferably curved. The curvature of the flanges of the interlocking members of the base is preferably substantially the same as the curvature of the flanges of the interlocking members of the body. This can maximize the frictional forces generated between the interlocking flanges which act against the movement of the body from the tilted position.

The stand preferably comprises a system for inhibiting the movement of the body relative to the base beyond a fully tilted position. The movement inhibiting system preferably comprises a stop member depending from the body for engaging part of the base when the body is in a fully tilted position. In the preferred embodiment the stop member is arranged to engage part of the interlocking members, preferably a flange of an interlocking member of the base, to inhibit movement of the body relative to the base beyond the fully tilted position The base preferably comprises a controller for controlling the fan assembly. For safety reasons and ease of use, it can be advantageous to locate control elements away from the tiltable body so that the control functions, such as, for example, oscillation, lighting or activation of a speed setting, are not activated during a tilt operation.

The fan assembly is preferably in the form of a bladeless fan assembly. Through use of a bladeless fan assembly an air current can be generated without the use of a bladed fan. Without the use of a bladed fan to project the air current from the fan assembly, a relatively uniform air current can be generated and guided into a room or towards a user. The air current can travel efficiently out from the outlet, losing little energy and velocity to turbulence.

The term 'bladeless' is used to describe a fan assembly in which air flow is emitted or projected forward from the fan assembly without the use of moving blades. Consequently, a bladeless fan assembly can be considered to have an output area, or emission zone, absent moving blades from which the air flow is directed towards a user or into a room. The output area of the bladeless fan assembly may be supplied with a primary air flow generated by one of a variety of different sources, such as pumps, generators, motors or other fluid transfer devices, and which may include a rotating device such as a motor rotor and/or a bladed impeller for generating the air flow. The generated primary air flow can pass from the room space or other environment outside the fan assembly into the fan assembly, and then back out to the room space through the outlet.

Hence, the description of a fan assembly as bladeless is not intended to extend to the description of the power source and components such as motors that are required for secondary fan functions. Examples of secondary fan functions can include lighting, adjustment and oscillation of the fan assembly.

The air outlet preferably comprises a nozzle mounted on the stand, the nozzle comprising a mouth for emitting the air flow, the nozzle extending about an opening through which air from outside the nozzle is drawn by the air flow emitted from the mouth. Preferably, the nozzle surrounds the opening. The nozzle may be an annular nozzle which preferably has a height in the range from 200 to 600 mm, more preferably in the range from 250 to 500 mm.

Preferably, the mouth of the nozzle extends about the opening, and is preferably annular. The nozzle preferably comprises an inner casing section and an outer casing section which define the mouth of the nozzle. Each section is preferably formed from a respective annular member, but each section may be provided by a plurality of members connected together or otherwise assembled to form that section. The outer casing section is preferably shaped so as to partially overlap the inner casing section. This can enable an outlet of the mouth to be defined between overlapping portions of the external surface of the inner casing section and the internal surface of the outer casing section of the nozzle. The outlet is preferably in the form of a slot, preferably having a width in the range from 0.5 to 5 mm, more preferably in the range from 0.5 to 1.5 mm. The nozzle may comprise a plurality of spacers for urging apart the overlapping portions of the inner casing section and the outer casing section of the nozzle. This can assist in maintaining a substantially uniform outlet width about the opening. The spacers are preferably evenly spaced along the outlet.

The nozzle preferably comprises an interior passage for receiving the air flow from the stand. The interior passage is preferably annular, and is preferably shaped to divide the air flow into two air streams which flow in opposite directions around the opening. The interior passage is preferably also defined by the inner casing section and the outer casing section of the nozzle.

The fan assembly preferably comprises a system for oscillating the nozzle so that the air current is swept over an arc, preferably in the range from 60 to 120°. For example, the base of the stand may comprise a system for oscillating an upper base member, to which the body is connected, relative to a lower base member.

The maximum air flow of the air current generated by the fan assembly is preferably in the range from 300 to 800 liters per second, more preferably in the range from 500 to 800 liters per second.

The nozzle may comprise a surface, preferably a Coanda surface, located adjacent the mouth and over which the mouth is arranged to direct the air flow emitted therefrom. Preferably, the external surface of the inner casing section of the nozzle is shaped to define the Coanda surface. The Coanda surface preferably extends about the opening. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the mouth.

Preferably, an air flow enters the nozzle of the fan assembly from the stand. In the following description this air flow will be referred to as primary air flow. The primary air flow is emitted from the mouth of the nozzle and preferably passes over a Coanda surface. The primary air flow entrains air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly, and passes predominantly through the opening defined by the nozzle. The primary air flow directed over the Coanda surface combined with the entrained secondary air flow equates to a total air flow emitted or projected forward from the opening defined by the nozzle. Preferably, the entrainment of air surrounding the mouth of the nozzle is such that the primary air flow is amplified by at least five times, more preferably by at least ten times, while a smooth overall output is maintained.

Preferably, the nozzle comprises a diffuser surface located downstream of the Coanda surface. The external surface of the inner casing section of the nozzle is preferably shaped to define the diffuser surface.

In a second aspect the present invention provides a fan assembly for creating an air current, the fan assembly comprising an air outlet mounted on a stand comprising a base and a body tiltable relative to the base from an untilted position to a tilted position, the air outlet comprising a nozzle mounted on the stand, the nozzle comprising a mouth for emitting the air flow, the nozzle extending about an opening through which air from outside the nozzle is drawn by the air flow emitted from the mouth, the fan assembly having a center of gravity located so that when the base is located on a substantially horizontal support surface, the projection of the center of gravity on the support surface is within the footprint of the base when the body is in a fully tilted position.

Features described above in relation to the first aspect of the invention are equally applicable to the second aspect of the invention, and vice versa.

BRIEF DESCRIPTION OF THE DRAWINGS

An embodiment of the invention will now be described with reference to the accompanying drawings, in which:

FIG. 5(*b*) is a side view of the fan assembly of FIG. 1 showing the fan assembly in a first tilted position;

FIG. 5(*c*) is a side view of the fan assembly of FIG. 1 showing the fan assembly in a second tilted position;

FIG. 9(*b*) is a sectional view along line A-A of FIG. 9(*a*);

FIG. 9(*c*) is a sectional view along line B-B of FIG. 9(*a*);

FIG. 10(*b*) is a sectional view along line C-C of FIG. 10(*a*); and

FIG. 10(*c*) is a sectional view along line D-D of FIG. 10(*a*);

DETAILED DESCRIPTION OF THE INVENTION

Figure 1:
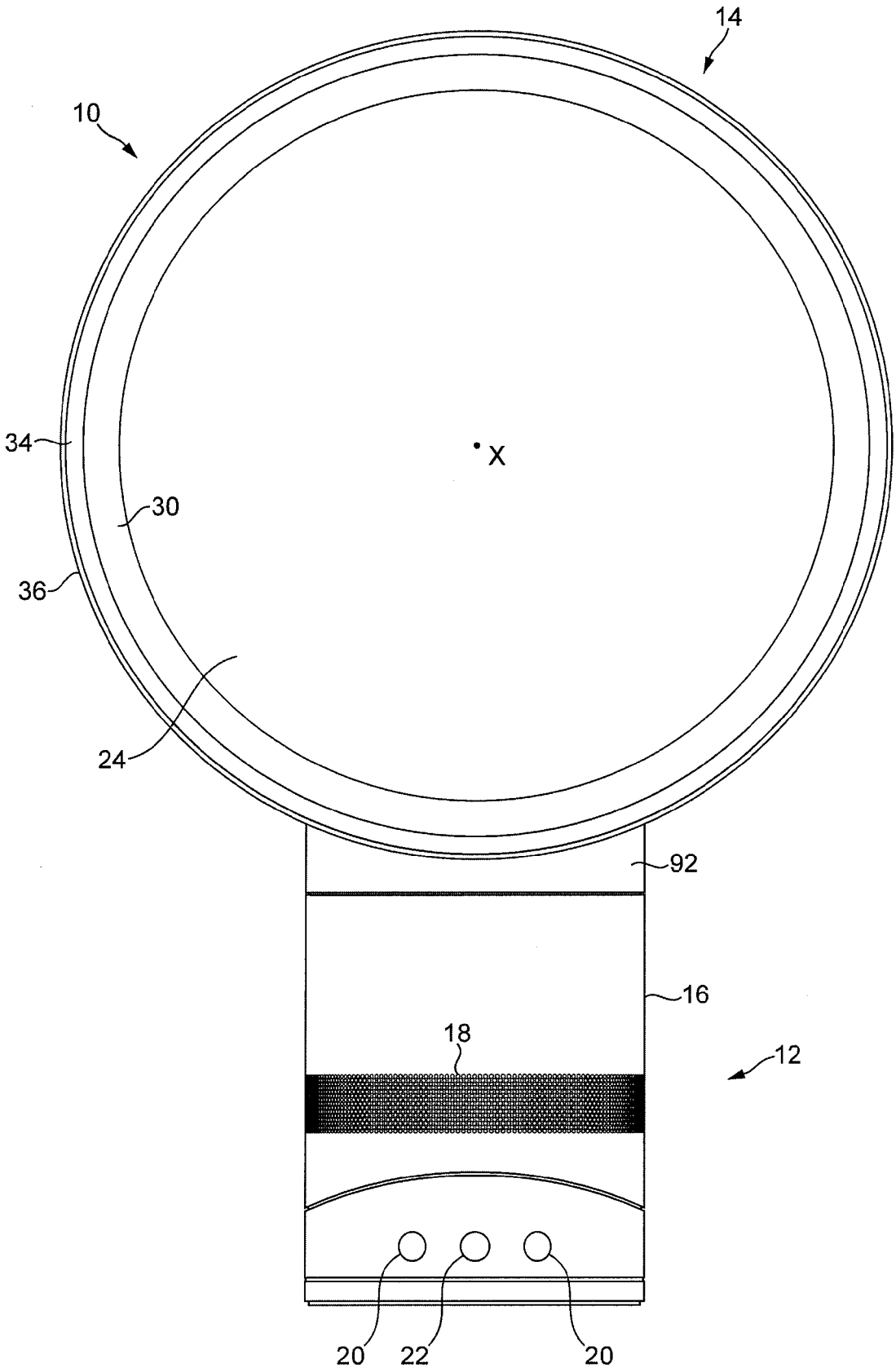
FIG. 1 is a front view of a fan assembly.

FIG. 1 is a front view of a fan assembly 10. The fan assembly 10 is preferably in the form of a bladeless fan assembly comprising a stand 12 and a nozzle 14 mounted on and supported by the stand 12. The stand 12 comprises a substantially cylindrical outer casing 16 having a plurality of air inlets 18 in the form of apertures located in the outer casing 16 and through which a primary air flow is drawn into the stand 12 from the external environment. The stand 12 further comprises a plurality of user-operable buttons 20 and a user-operable dial 22 for controlling the operation of the fan assembly 10. The stand 12 preferably has a height in the range from 200 to 300 mm, and the outer casing 16 preferably has an external diameter in the range from 100 to 200 mm. In this example, the stand 12 has a height h of around 190 mm, and an external diameter 2 r of around 145 mm.

Figure 2:
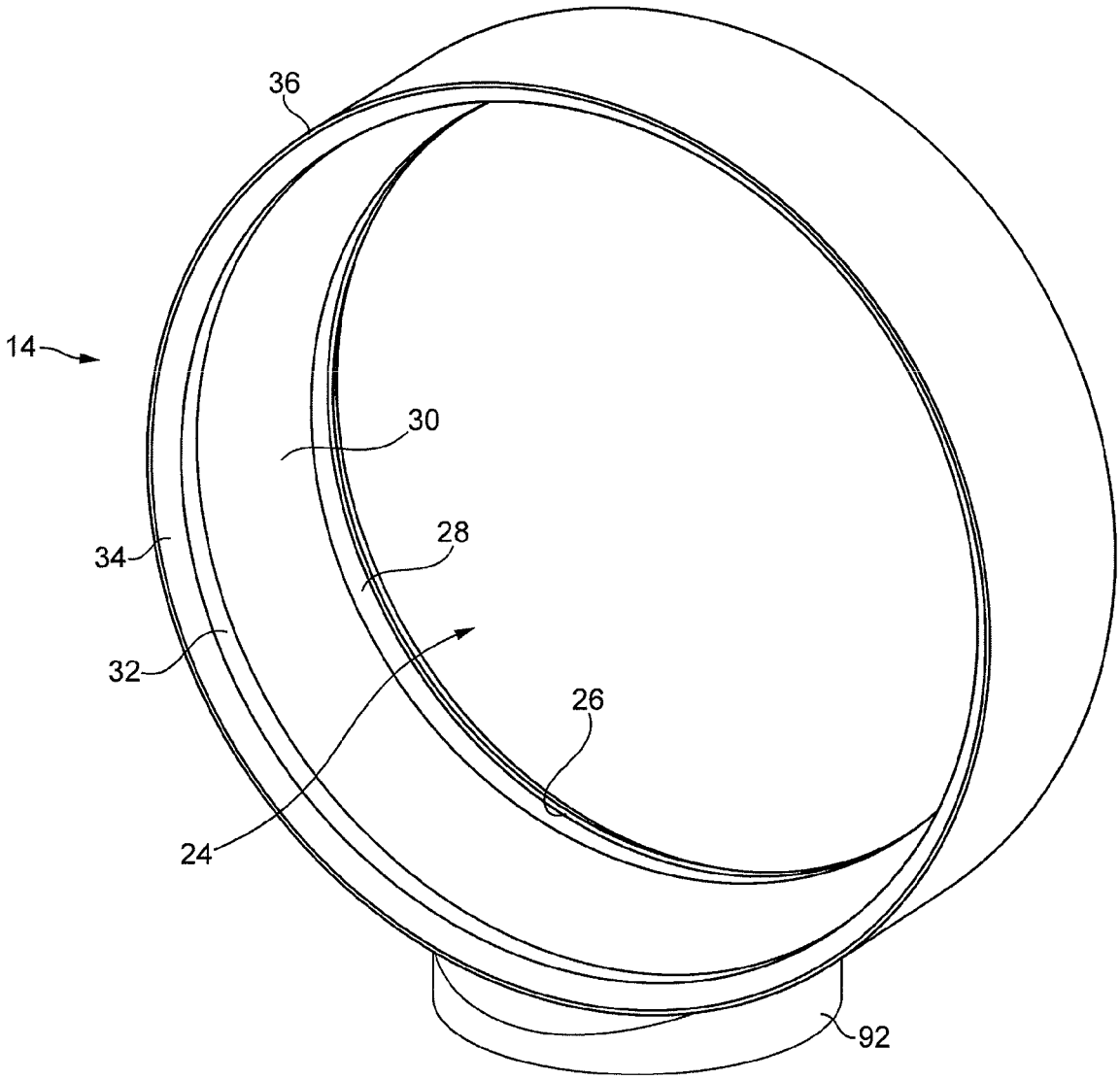
FIG. 2 is a perspective view of the nozzle of the fan assembly of FIG. 1.

With reference also to FIG. 2, the nozzle 14 has an annular shape and defines a central opening 24. The nozzle 14 has a height in the range from 200 to 400 mm. The nozzle 14 comprises a mouth 26 located towards the rear of the fan assembly 10 for emitting air from the fan assembly 10 and through the opening 24. The mouth 26 extends at least partially about the opening 24. The inner periphery of the nozzle 14 comprises a Coanda surface 28 located adjacent the mouth 26 and over which the mouth 26 directs the air emitted from the fan assembly 10, a diffuser surface 30 located downstream of the Coanda surface 28 and a guide surface 32 located downstream of the diffuser surface 30. The diffuser surface 30 is arranged to taper away from the central axis X of the opening 24 in such a way so as to assist the flow of air emitted from the fan assembly 10. The angle subtended between the diffuser surface 30 and the central axis X of the opening 24 is in the range from 5 to 25°, and in this example is around 15°. The guide surface 32 is arranged at an angle to the diffuser surface 30 to further assist the efficient delivery of a cooling air flow from the fan assembly 10. The guide surface 32 is preferably arranged substantially parallel to the central axis X of the opening 24 to present a substantially flat and substantially smooth face to the air flow emitted from the mouth 26. A visually appealing tapered surface 34 is located downstream from the guide surface 32, terminating at a tip surface 36 lying substantially perpendicular to the central axis X of the opening 24. The angle subtended between the tapered surface 34 and the central axis X of the opening 24 is preferably around 45°. The overall depth of the nozzle 24 in a direction extending along the central axis X of the opening 24 is in the range from 100 to 150 mm, and in this example is around 110 mm.

Figure 3:
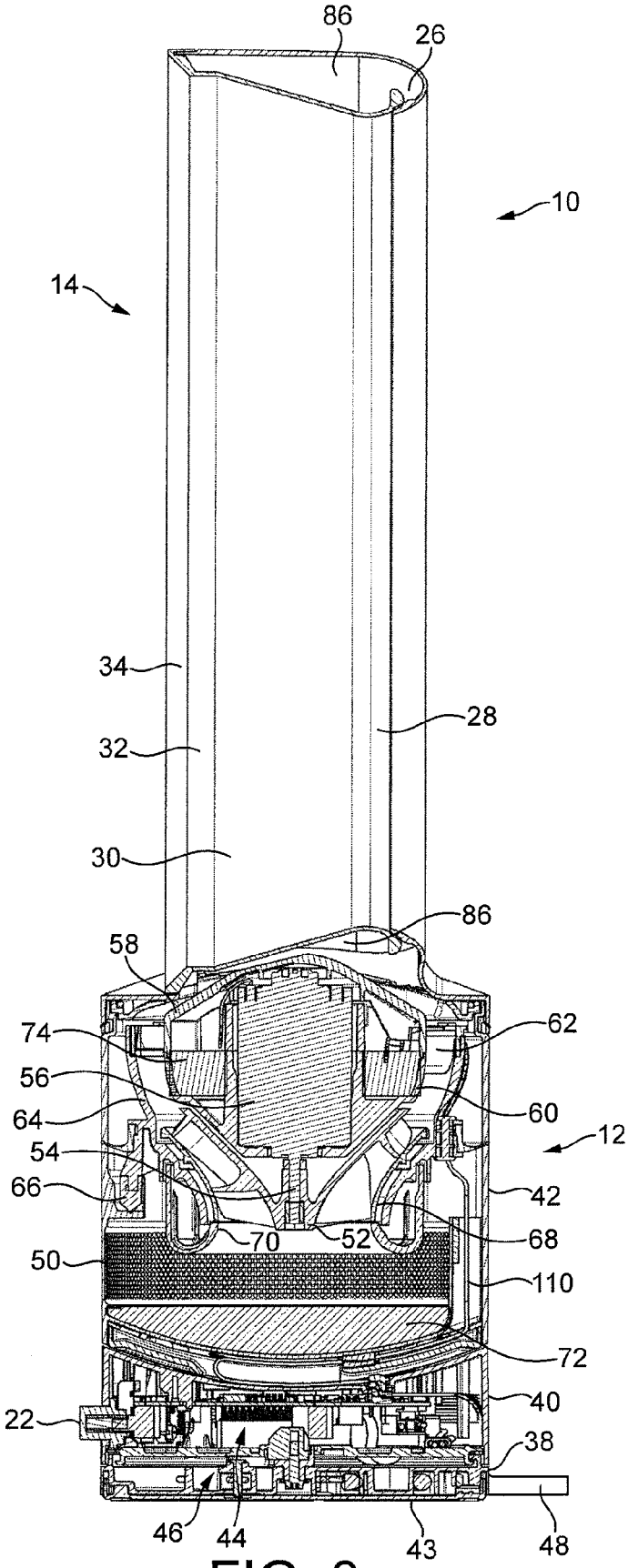
FIG. 3 is a sectional view through the fan assembly of FIG. 1.

FIG. 3 illustrates a sectional view through the fan assembly 10. The stand 12 comprises a base formed from a lower base member 38 and an upper base member 40 mounted on the lower base member 38, and a main body 42 mounted on the base. The lower base member 38 has a substantially flat, substantially circular bottom surface 43 for engaging a support surface upon which the fan assembly 10 is located. Due to the cylindrical nature of the base, the footprint of the base is the same size as the bottom surface 43 of the lower base member 38, and so the footprint of the base has a radius r. The upper base member 40 houses a controller 44 for controlling the operation of the fan assembly 10 in response to depression of the user operable buttons 20 shown in FIGS. 1 and 2, and/or manipulation of the user operable dial 22. The upper base member 40 may also house an oscillating mechanism 46 for oscillating the upper base member 40 and the main body 42 relative to the lower base member 38. The range of each oscillation cycle of the main body 42 is preferably between 60° and 120°, and in this example is around 90°. In this example, the oscillating mechanism 46 is arranged to perform around 3 to 5 oscillation cycles per minute. A mains power cable 48 extends through an aperture formed in the lower base member 38 for supplying electrical power to the fan assembly 10.

The main body 42 of the stand 12 has an open upper end to which the nozzle 14 is connected, for example by a snap-fit connection. The main body 42 comprises a cylindrical grille 50 in which an array of apertures is formed to provide the air inlets 18 of the stand 12. The main body 42 houses an impeller 52 for drawing the primary air flow through the apertures of the grille 50 and into the stand 12. Preferably, the impeller 52 is in the form of a mixed flow impeller. The impeller 52 is connected to a rotary shaft 54 extending outwardly from a motor 56. In this example, the motor 56 is a DC brushless motor having a speed which is variable by the controller 44 in response to user manipulation of the dial 22. The maximum speed of the motor 56 is preferably in the range from 5,000 to 10,000 rpm. The motor 56 is housed within a motor bucket comprising an upper portion 58 connected to a lower portion 60. One of the upper portion 58 and the lower portion 60 of the motor bucket comprises a diffuser 62 in the form of a stationary disc having spiral blades, and which is located downstream from the impeller 52.

The motor bucket is located within, and mounted on, an impeller housing 64. The impeller housing 64 is, in turn, mounted on a plurality of angularly spaced supports 66, in this example three supports, located within the main body 42 of the stand 12. A generally frustro-conical shroud 68 is located within the impeller housing 64. The shroud 68 is shaped so that the outer edges of the impeller 52 are in close proximity to, but do not contact, the inner surface of the shroud 68. A substantially annular inlet member 70 is connected to the bottom of the impeller housing 64 for guiding the primary air flow into the impeller housing 64. Preferably, the stand 12 further comprises silencing foam for reducing noise emissions from the stand 12. In this example, the main body 42 of the stand 12 comprises a disc-shaped foam member 72 located towards the base of the main body 42, and a substantially annular foam member 74 located within the motor bucket.

Figure 4:
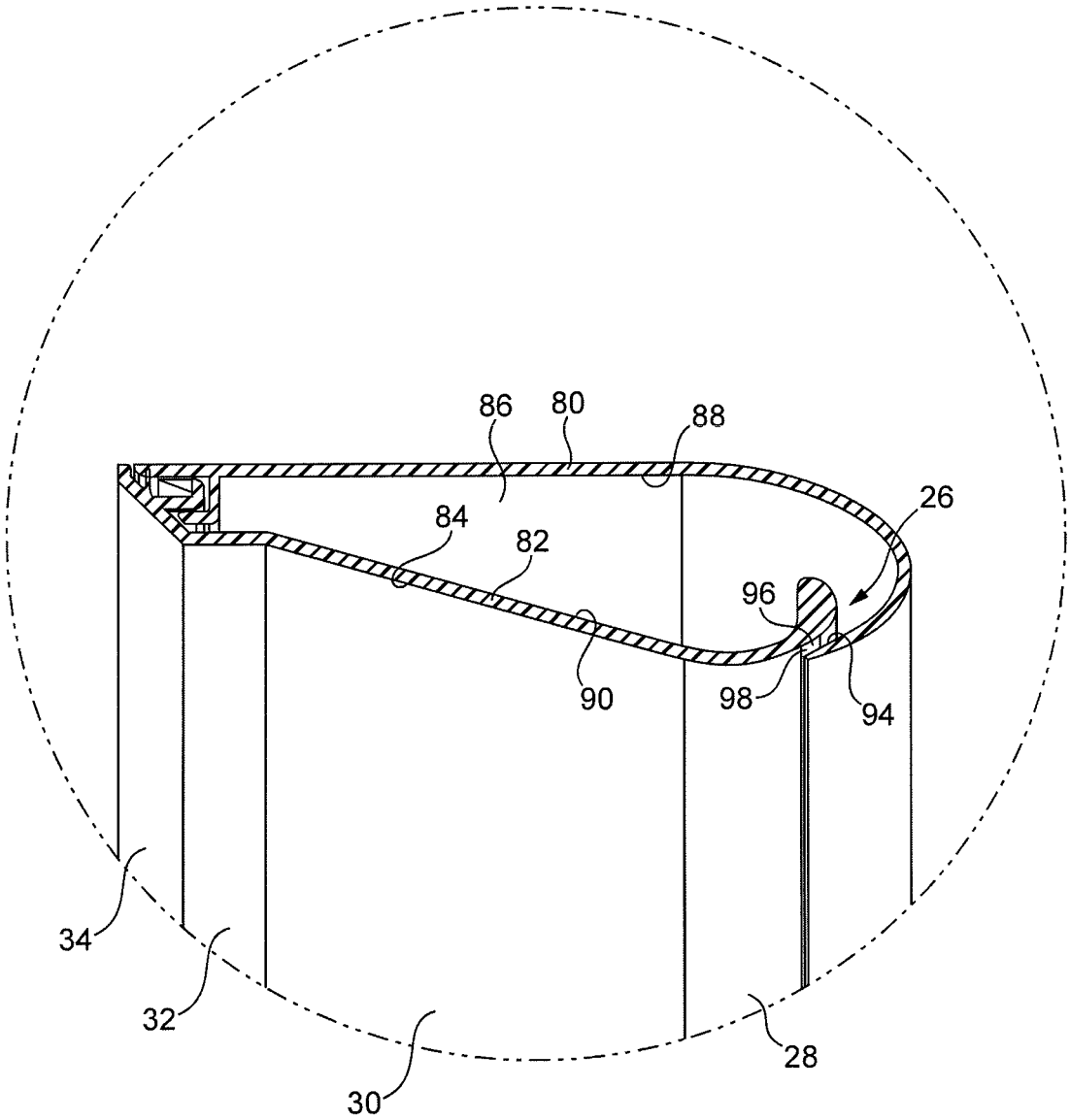
FIG. 4 is an enlarged view of part of FIG. 3.

FIG. 4 illustrates a sectional view through the nozzle 14. The nozzle 14 comprises an annular outer casing section 80 connected to and extending about an annular inner casing section 82. Each of these sections may be formed from a plurality of connected parts, but in this embodiment each of the outer casing section 80 and the inner casing section 82 is formed from a respective, single molded part. The inner casing section 82 defines the central opening 24 of the nozzle 14, and has an external peripheral surface 84 which is shaped to define the Coanda surface 28, diffuser surface 30, guide surface 32 and tapered surface 34.

The outer casing section 80 and the inner casing section 82 together define an annular interior passage 86 of the nozzle 14. Thus, the interior passage 86 extends about the opening 24. The interior passage 86 is bounded by the internal peripheral surface 88 of the outer casing section 80 and the internal peripheral surface 90 of the inner casing section 82. The outer casing section 80 comprises a base 92 which is connected to, and over, the open upper end of the main body 42 of the stand 12, for example by a snap-fit connection. The base 92 of the outer casing section 80 comprises an aperture through which the primary air flow enters the interior passage 86 of the nozzle 14 from the open upper end of the main body 42 of the stand 12.

The mouth 26 of the nozzle 14 is located towards the rear of the fan assembly 10. The mouth 26 is defined by overlapping, or facing, portions 94, 96 of the internal peripheral surface 88 of the outer casing section 80 and the external peripheral surface 84 of the inner casing section 82, respectively. In this example, the mouth 26 is substantially annular and, as illustrated in FIG. 4, has a substantially U-shaped cross-section when sectioned along a line passing diametrically through the nozzle 14. In this example, the overlapping portions 94, 96 of the internal peripheral surface 88 of the outer casing section 80 and the external peripheral surface 84 of the inner casing section 82 are shaped so that the mouth 26 tapers towards an outlet 98 arranged to direct the primary flow over the Coanda surface 28. The outlet 98 is in the form of an annular slot, preferably having a relatively constant width in the range from 0.5 to 5 mm. In this example the outlet 98 has a width of around 1.1 mm. Spacers may be spaced about the mouth 26 for urging apart the overlapping portions 94, 96 of the internal peripheral surface 88 of the outer casing section 80 and the external peripheral surface 84 of the inner casing section 82 to maintain the width of the outlet 98 at the desired level. These spacers may be integral with either the internal peripheral surface 88 of the outer casing section 80 or the external peripheral surface 84 of the inner casing section 82.

Figure 5:
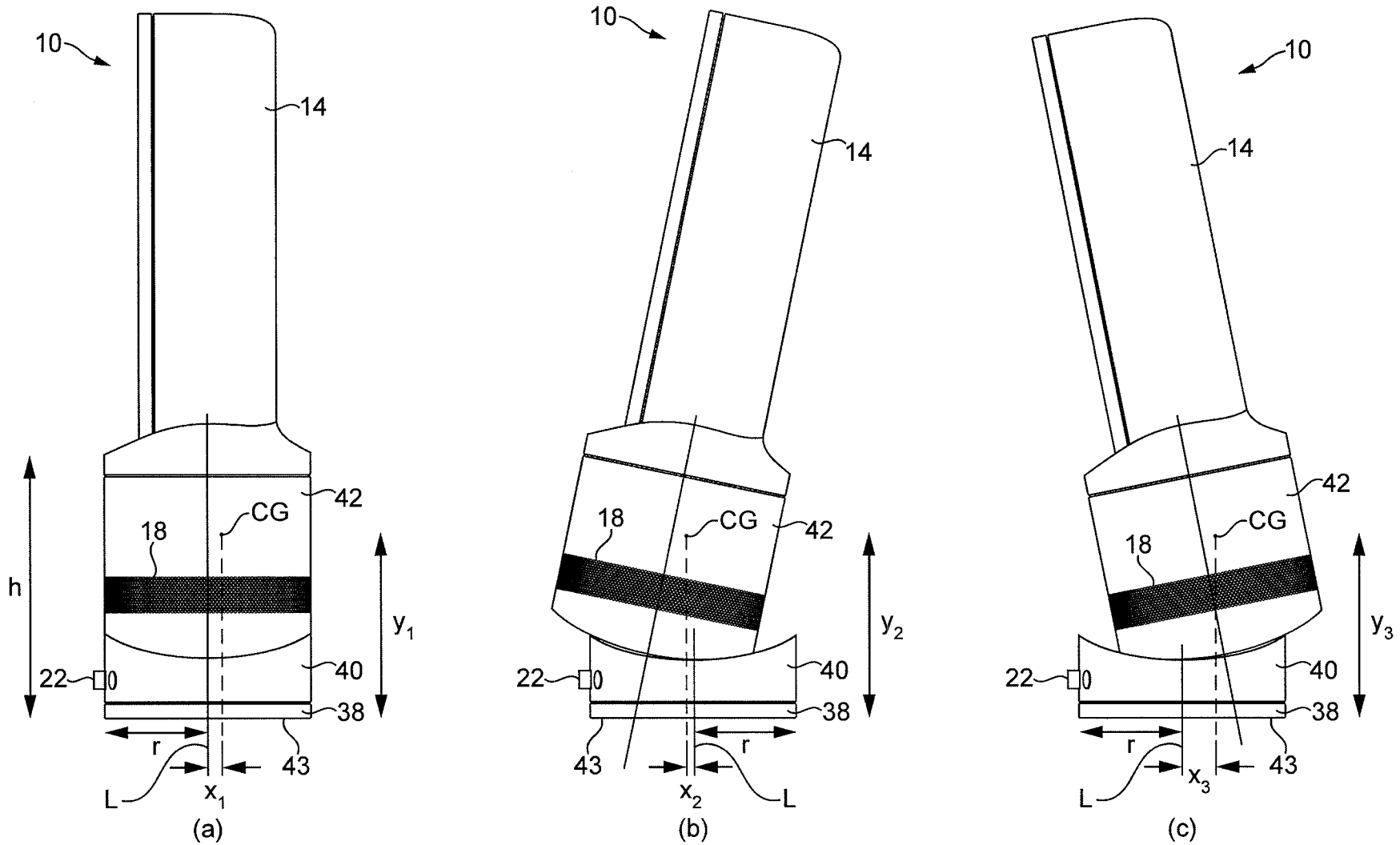
FIG. 5(*a*) is a side view of the fan assembly of FIG. 1 showing the fan assembly in an untilted position.

Turning now to FIGS. 5(*a*), 5(*b*) and 5(*c*), the main body 42 is moveable relative to the base of the stand 12 between a first fully tilted position, as illustrated in FIG. 5(*b*), and a second fully tilted position, as illustrated in FIG. 5(*c*). This axis X is preferably inclined by an angle of around 10° as the main body 42 is moved from an untilted position, as illustrated in FIG. 5(*a*) to one of the two fully tilted positions. The outer surfaces of the main body 42 and the upper base member 40 are shaped so that adjoining portions of these outer surfaces of the main body 42 and the base are substantially flush when the main body 42 is in the untilted position.

The center of gravity of the fan assembly is identified at CG in FIGS. 5(*a*), 5(*b*) and 5(*c*). The center of gravity CG is located within the main body 42 of the stand 12. When the lower base member 38 of the stand 12 is located on a horizontal support surface, the projection of the center of gravity CG on the support surface is within the footprint of the base, irrespective of the position of the main body 42 between the first and second fully tilted positions, so that the fan assembly 10 is in a stable configuration irrespective of the position of the main body 42.

With reference to FIG. 5(*a*), when the main body 42 is in the untitled position the projection of the center of gravity CG on the support surface lies behind the center of the base with respect to a forward direction of the fan assembly, which is from right to left as viewed in FIGS. 5(*a*), 5(*b*) and 5(*c*). In this example, the radial distance $x_1$ between the longitudinal axis L of the base and the center of gravity CG is around 0.15 r, where r is the radius of the bottom surface 43 of the lower base member 38, and the distance $y_1$ along the longitudinal axis L between the bottom surface 43 and the center of gravity is around 0.7 h, where h is the height of the stand 12. When the main body 42 is in the first fully titled position illustrated in FIG. 5(*b*) the projection of the center of gravity CG on the support surface lies slightly in front of the center of the base. In this example, the radial distance $x_2$ between the longitudinal axis L of the base and the center of gravity CG is around 0.05 r, while the distance $y_2$ along the longitudinal axis L between the bottom surface 43 and the center of gravity remains around 0.7 h. When the main body 42 is in the second fully titled position illustrated in FIG. 5(*c*), the projection of the center of gravity CG on the support surface lies behind the center of the base. In this example, the radial distance $x_3$ between the longitudinal axis L of the base and the center of gravity CG is around 0.35 r, while the distance $y_3$ along the longitudinal axis L between the bottom surface 43 and the center of gravity remains around 0.7 h. The difference between $y_2$ and $y_3$ is preferably no more than 5 mm, more preferably no more than 2 mm.

Figure 6:
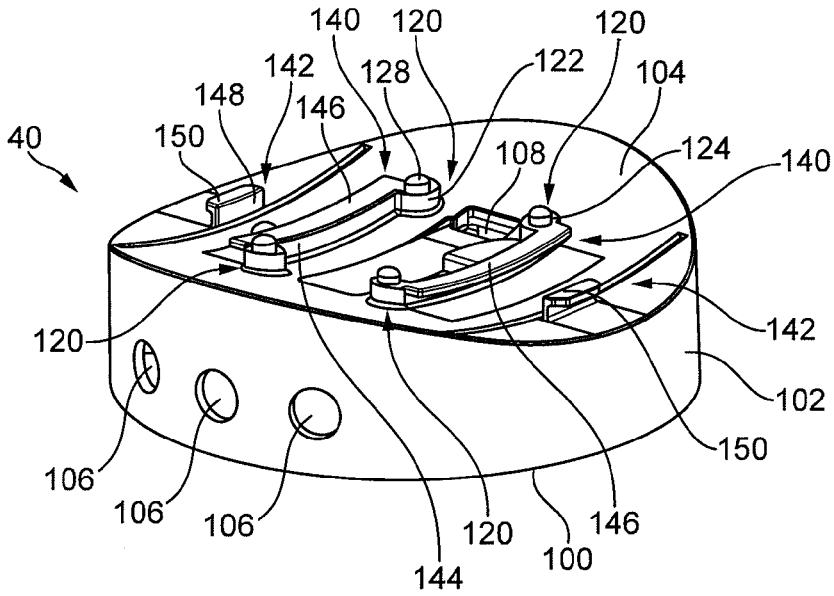
FIG. 6 is a top perspective view of the upper base member of the fan assembly of FIG. 1.

With reference to FIG. 6, the upper base member 40 comprises an annular lower surface 100 which is mounted on the lower base member 38, a substantially cylindrical side wall 102 and a curved upper surface 104. The side wall 102 comprises a plurality of apertures 106. The user-operable dial 22 protrudes through one of the apertures 106 whereas the user-operable buttons 20 are accessible through the other apertures 106. The curved upper surface 104 of the upper base member 40 is concave in shape, and may be described as generally saddle-shaped. An aperture 108 is formed in the upper surface 104 of the upper base member 40 for receiving an electrical cable 110 (shown in FIG. 3) extending from the motor 56.

Figure 9:
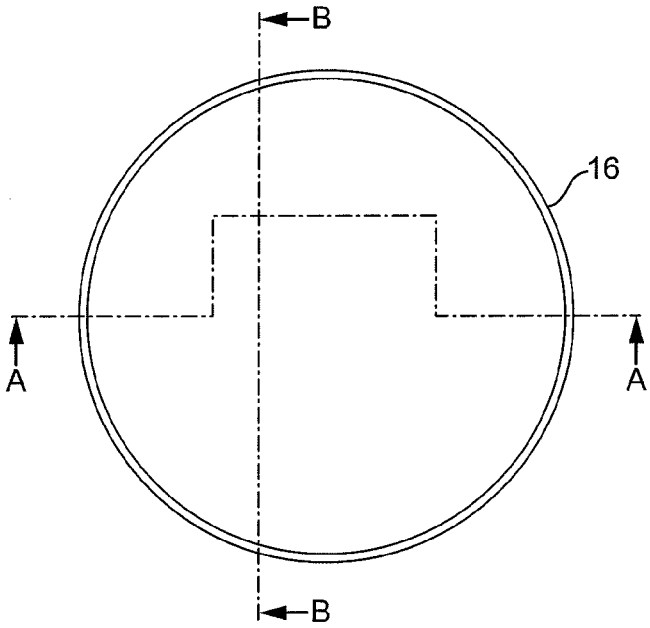
FIG. 9(*a*) illustrates the paths of two sectional views through the stand when the fan assembly is in an untilted position.
Figure 9:
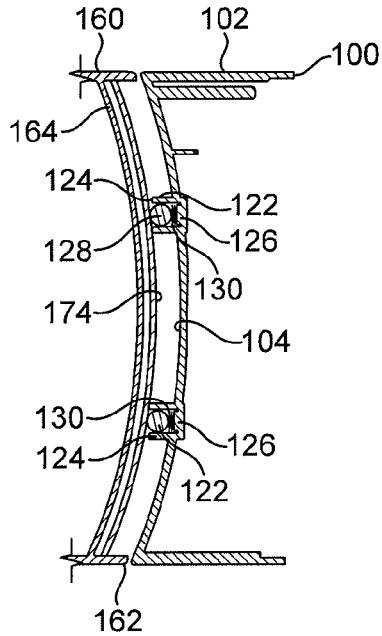
Figure 9:
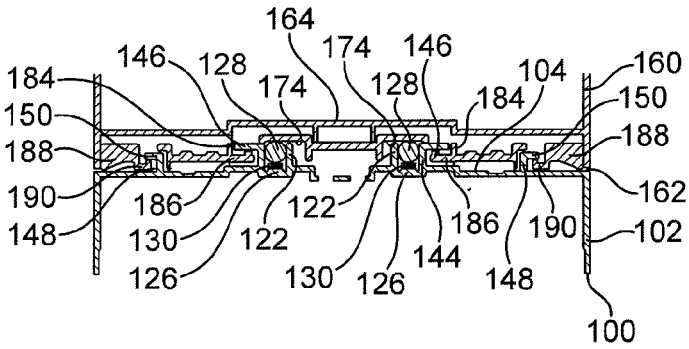

The upper base member 40 further comprises four support members 120 for supporting the main body 42 on the upper base member 40. The support members 120 project upwardly from the upper surface 104 of the upper base member 40, and are arranged such that they are substantially equidistant from each other, and substantially equidistant from the center of the upper surface 104. A first pair of the support members 120 is located along the line B-B indicated in FIG. 9(*a*), and a second pair of the support members 120 is parallel with the first pair of support members 120. With reference also to FIGS. 9(*b*) and 9(*c*), each support member 120 comprises a cylindrical outer wall 122, an open upper end 124 and a closed lower end 126. The outer wall 122 of the support member 120 surrounds a rolling element 128 in the form of a ball bearing. The rolling element 128 preferably has a radius which is slightly smaller than the radius of the cylindrical outer wall 122 so that the rolling element 128 is retained by and moveable within the support member 120. The rolling element 128 is urged away from the upper surface 104 of the upper base member 40 by a resilient element 130 located between the closed lower end 126 of the support member 120 and the rolling element 128 so that part of the rolling element 128 protrudes beyond the open upper end 124 of the support member 120. In this embodiment, the resilient member 130 is in the form of a coiled spring.

Figure 10:
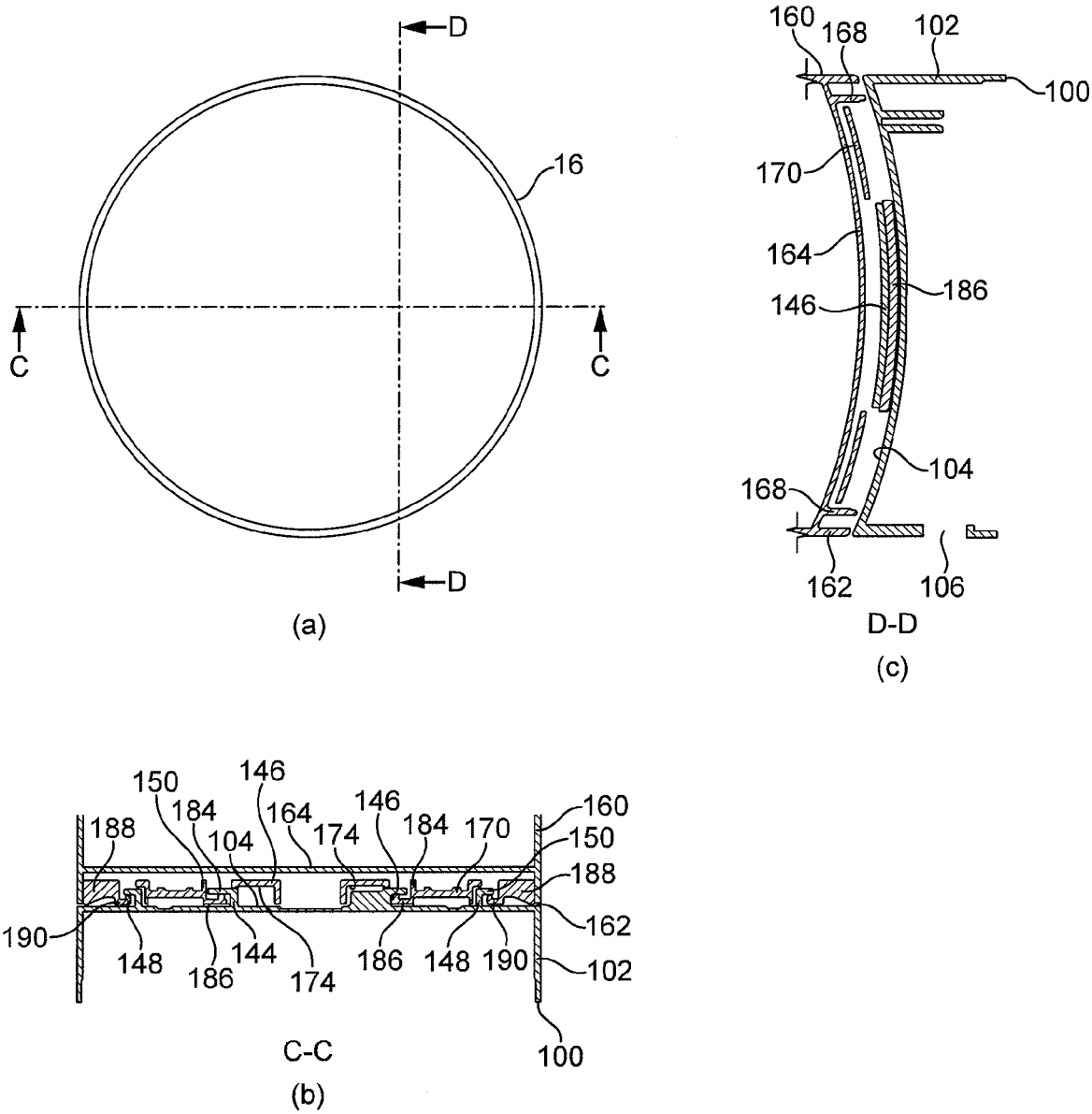
FIG. 10(*a*) illustrates the paths of two further sectional views through the stand when the fan assembly is in an untilted position.

Returning to FIG. 6, the upper base member 40 also comprises a plurality of rails for retaining the main body 42 on the upper base member 40. The rails also serve to guide the movement of the main body 42 relative to the upper base member 40 so that there is substantially no twisting or rotation of the main body 42 relative to the upper base member 40 as it is moved from or to a tilted position. Each of the rails extends in a direction substantially parallel to the axis X. For example, one of the rails lies along line D-D indicated in FIG. 10(*a*). In this embodiment, the plurality of rails comprises a pair of relatively long, inner rails 140 located between a pair of relatively short, outer rails 142. With reference also to FIGS. 9(*b*) and 10(*b*), each of the inner rails 140 has a cross-section in the form of an inverted L-shape, and comprises a wall 144 which extends between a respective pair of the support members 120, and which is connected to, and upstanding from, the upper surface 104 of the upper base member 40. Each of the inner rails 140 further comprises a curved flange 146 which extends along the length of the wall 144, and which protrudes orthogonally from the top of the wall 144 towards the adjacent outer guide rail 142. Each of the outer rails 142 also has a cross-section in the form of an inverted L-shape, and comprises a wall 148 which is connected to, and upstanding from, the upper surface 52 of the upper base member 40 and a curved flange 150 which extends along the length of the wall 148, and which protrudes orthogonally from the top of the wall 148 away from the adjacent inner guide rail 140.

Figure 7:
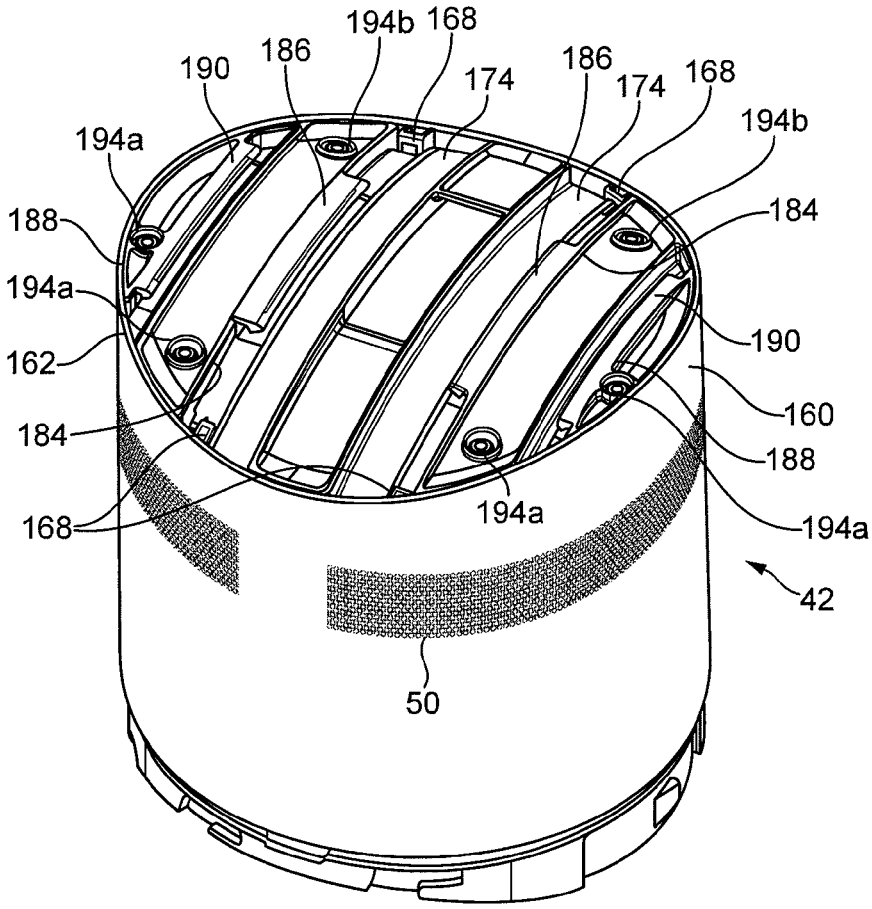
FIG. 7 is a rear perspective view of the main body of the fan assembly of FIG. 1.
Figure 8:
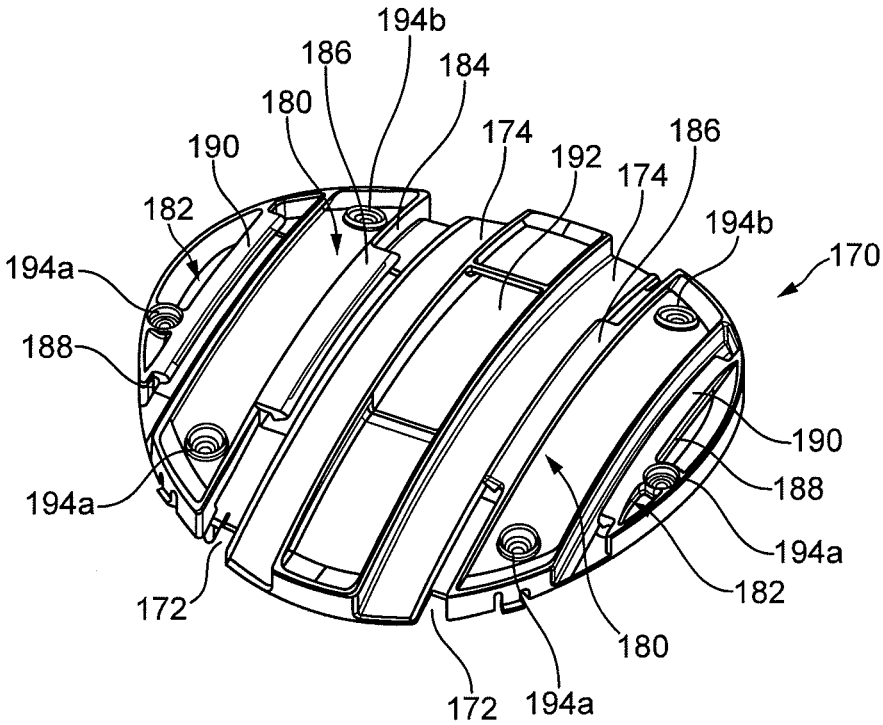
FIG. 8 is an exploded view of the main body of FIG. 7.
Figure 8:
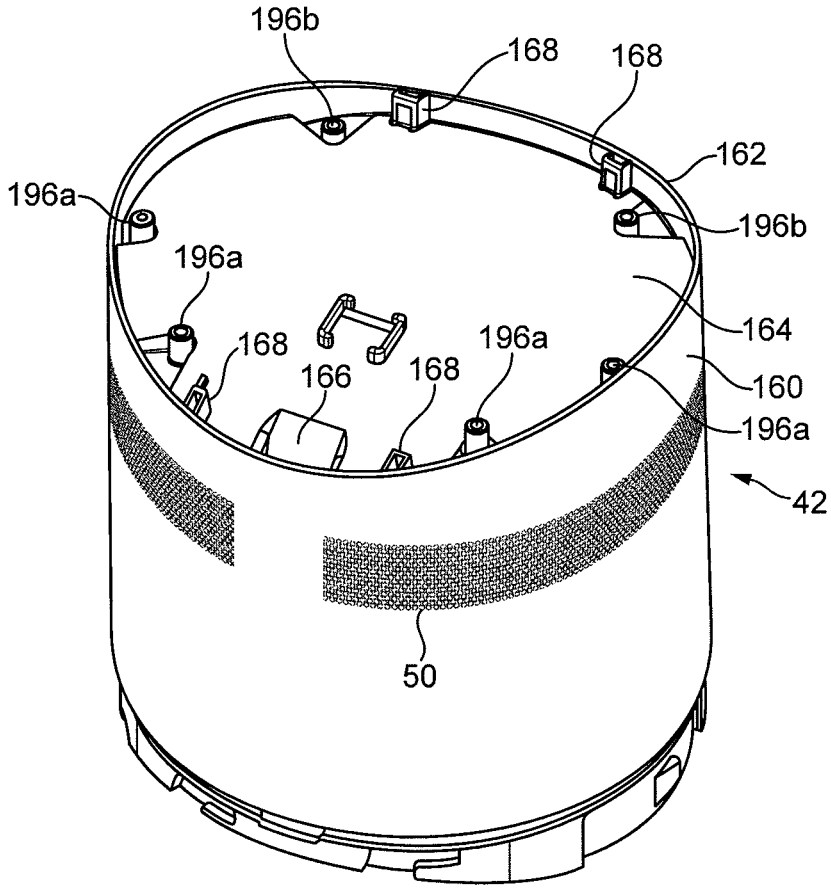

With reference now to FIGS. 7 and 8, the main body 42 comprises a substantially cylindrical side wall 160, an annular lower end 162 and a curved base 164 which is spaced from lower end 162 of the main body 42 to define a recess. The grille 50 is preferably integral with the side wall 160. The side wall 160 of the main body 42 has substantially the same external diameter as the side wall 102 of the upper base member 40. The base 164 is convex in shape, and may be described generally as having an inverted saddle-shape. An aperture 166 is formed in the base 164 for allowing the cable 110 to extend from the base 164 of the main body 42. Two pairs of stop members 168 extend upwardly (as illustrated in FIG. 8) from the periphery of base 164. Each pair of stop members 168 is located along a line extending in a direction substantially parallel to the axis X. For example, one of the pairs of stop members 168 is located along line D-D illustrated in FIG. 10(*a*).

A convex tilt plate 170 is connected to the base 164 of the main body 42. The tilt plate 170 is located within the recess of the main body 42, and has a curvature which is substantially the same as that of the base 164 of the main body 42. Each of the stop members 168 protrudes through a respective one of a plurality of apertures 172 located about the periphery of the tilt plate 170. The tilt plate 170 is shaped to define a pair of convex races 174 for engaging the rolling elements 128 of the upper base member 40. Each race 174 extends in a direction substantially parallel to the axis X, and is arranged to receive the rolling elements 128 of a respective pair of the support members 120, as illustrated in FIG. 9(*c*).

The tilt plate 170 also comprises a plurality of runners, each of which is arranged to be located at least partially beneath a respective rail of the upper base member 40 and thus co-operate with that rail to retain the main body 42 on the upper base member 40 and to guide the movement of the main body 42 relative to the upper base member 40. Thus, each of the runners extends in a direction substantially parallel to the axis X. For example, one of the runners lies along line D-D indicated in FIG. 10(*a*). In this embodiment, the plurality of runners comprises a pair of relatively long, inner runners 180 located between a pair of relatively short, outer runners 182. With reference also to FIGS. 9(*b*) and 10(*b*), each of the inner runners 180 has a cross-section in the form of an inverted L-shape, and comprises a substantially vertical wall 184 and a curved flange 186 which protrudes orthogonally and inwardly from part of the top of the wall 184. The curvature of the curved flange 186 of each inner runner 180 is substantially the same as the curvature of the curved flange 146 of each inner rail 140. Each of the outer runners 182 also has a cross-section in the form of an inverted L-shape, and comprises a substantially vertical wall 188 and a curved flange 190 which extends along the length of the wall 188, and which protrudes orthogonally and inwardly from the top of the wall 188. Again, the curvature of the curved flange 190 of each outer runner 182 is substantially the same as the curvature of the curved flange 150 of each outer rail 142. The tilt plate 170 further comprises an aperture 192 for receiving the cable 110.

To connect the main body 42 to the upper base member 40, the tilt plate 170 is inverted from the orientation illustrated in FIGS. 7 and 8, and the races 174 of the tilt plate located directly behind and in line with the support members 120 of the upper base member 40. The cable 110 extending through the aperture 166 of the main body 42 may be threaded through the apertures 108, 192 in the tilt plate 170 and the upper base member 40 respectively for subsequent connection to the controller 44, as illustrated in FIG. 3. The tilt plate 170 is then slid over the upper base member 40 so that the rolling elements 128 engage the races 174, as illustrated in FIGS. 9(*b*) and 9(*c*), the curved flange 190 of each outer runner 182 is located beneath the curved flange 150 of a respective outer rail 142, as illustrated in FIGS. 9(*b*) and 10(*b*), and the curved flange 186 of each inner runner 180 is located beneath the curved flange 146 of a respective inner rail 140, as illustrated in FIGS. 9(*b*), 10(*b*) and 10(*c*).

With the tilt plate 170 positioned centrally on the upper base member 40, the main body 42 is lowered on to the tilt plate 170 so that the stop members 168 are located within the apertures 172 of the tilt plate 170, and the tilt plate 170 is housed within the recess of the main body 42. The upper base member 40 and the main body 42 are then inverted, and the base member 40 displaced along the direction of the axis X to reveal a first plurality of apertures 194*a* located on the tilt plate 170. Each of these apertures 194*a* is aligned with a tubular protrusion 196*a* on the base 164 of the main body 42. A self-tapping screw is screwed into each of the apertures 194*a* to enter the underlying protrusion 196*a*, thereby partially connecting the tilt plate 170 to the main body 42. The upper base member 40 is then displaced in the reverse direction to reveal a second plurality of apertures 194*b* located on the tilt plate 170. Each of these apertures 194*b* is also aligned with a tubular protrusion 196*b* on the base 164 of the main body 42. A self-tapping screw is screwed into each of the apertures 194*b* to enter the underlying protrusion 196*b* to complete the connection of the tilt plate 170 to the main body 42.

When the main body 42 is attached to the base and the bottom surface 43 of the lower base member 38 positioned on a support surface, the main body 42 is supported by the rolling elements 128 of the support members 120. The resilient elements 130 of the support members 120 urge the rolling elements 128 away from the closed lower ends 126 of the support members 120 by a distance which is sufficient to inhibit scraping of the upper surfaces of the upper base member 40 when the main body 42 is tilted. For example, as illustrated in each of FIGS. 9(*b*), 9(*c*), 10(*b*) and 10(*c*) the lower end 162 of the main body 42 is urged away from the upper surface 104 of the upper base member 40 to prevent contact therebetween when the main body 42 is tilted. Furthermore, the action of the resilient elements 130 urges the concave upper surfaces of the curved flanges 186, 190 of the runners against the convex lower surfaces of the curved flanges 146, 150 of the rails.

To tilt the main body 42 relative to the base, the user slides the main body 42 in a direction parallel to the axis X to move the main body 42 towards one of the fully tilted positions illustrated in FIGS. 5(*b*) and 5(*c*), causing the rolling elements 128 to move along the races 174. Once the main body 42 is in the desired position, the user releases the main body 42, which is retained in the desired position by frictional forces generated through the contact between the concave upper surfaces of the curved flanges 186, 190 of the runners and the convex lower surfaces of the curved flanges 146, 150 of the rails acting to resist the movement under gravity of the main body 42 towards the untilted position illustrated in FIG. 5(*a*). The fully titled positions of the main body 42 are defined by the abutment of one of each pair of stop members 168 with a respective inner rail 140.

To operate the fan assembly 10 the user depresses an appropriate one of the buttons 20 on the stand 12, in response to which the controller 44 activates the motor 56 to rotate the impeller 52. The rotation of the impeller 52 causes a primary air flow to be drawn into the stand 12 through the air inlets 18. Depending on the speed of the motor 56, the primary air flow may be between 20 and 30 liters per second. The primary air flow passes sequentially through the impeller housing 64 and the open upper end of the main body 42 to enter the interior passage 86 of the nozzle 14. Within the nozzle 14, the primary air flow is divided into two air streams which pass in opposite directions around the central opening 24 of the nozzle 14. As the air streams pass through the interior passage 86, air enters the mouth 26 of the nozzle 14. The air flow into the mouth 26 is preferably substantially even about the opening 24 of the nozzle 14. Within each section of the mouth 26, the flow direction of the portion of the air stream is substantially reversed. The portion of the air stream is constricted by the tapering section of the mouth 26 and emitted through the outlet 98.

The primary air flow emitted from the mouth 26 is directed over the Coanda surface 28 of the nozzle 14, causing a secondary air flow to be generated by the entrainment of air from the external environment, specifically from the region around the outlet 98 of the mouth 26 and from around the rear of the nozzle 14. This secondary air flow passes through the central opening 24 of the nozzle 14, where it combines with the primary air flow to produce a total air flow, or air current, projected forward from the nozzle 14. Depending on the speed of the motor 56, the mass flow rate of the air current projected forward from the fan assembly 10 may be up to 400 liters per second, preferably up to 600 liters per second, and the maximum speed of the air current may be in the range from 2.5 to 4 m/s.

The even distribution of the primary air flow along the mouth 26 of the nozzle 14 ensures that the air flow passes evenly over the diffuser surface 30. The diffuser surface 30 causes the mean speed of the air flow to be reduced by moving the air flow through a region of controlled expansion. The relatively shallow angle of the diffuser surface 30 to the central axis X of the opening 24 allows the expansion of the air flow to occur gradually. A harsh or rapid divergence would otherwise cause the air flow to become disrupted, generating vortices in the expansion region. Such vortices can lead to an increase in turbulence and associated noise in the air flow which can be undesirable, particularly in a domestic product such as a fan. The air flow projected forwards beyond the diffuser surface 30 can tend to continue to diverge. The presence of the guide surface 32 extending substantially parallel to the central axis X of the opening 30 further converges the air flow. As a result, the air flow can travel efficiently out from the nozzle 14, enabling the air flow can be experienced rapidly at a distance of several meters from the fan assembly 10.

The invention is not limited to the detailed description given above. Variations will be apparent to the person skilled in the art. For example, the stand 12 may be used in a variety of appliances other than a fan assembly. The movement of the main body 42 relative to the base may be motorized, and actuated by the user through depression of one of the buttons 20.

The invention claimed is:

1. A fan assembly for creating an air current, the fan assembly comprising an air outlet mounted on a stand comprising a base and a body tiltable relative to the base from an untilted position to a tilted position, the fan assembly having a center of gravity located so that when the base is located on a substantially horizontal support surface, a projection of the center of gravity on the support surface is within the footprint of the base when the body is in a fully tilted position, wherein the body comprises a system for creating an air flow through the fan assembly and the air outlet comprises a nozzle mounted on the body of the stand, the nozzle comprising a mouth for emitting the air flow, the nozzle extending about an opening through which air from outside the nozzle is drawn by the air flow emitted from the mouth.

2. The fan assembly of claim 1, wherein the center of gravity of the fan assembly is located within the body.

3. The fan assembly of claim 1, wherein the system for creating the air flow comprises an impeller and a motor for driving the impeller.

4. The fan assembly of claim 1, wherein the projection of the center of gravity on the support surface is behind the center of the base with respect to a forward direction of the fan assembly when the body is in an untilted position.

5. The fan assembly of claim 1, comprising interlocking members for retaining the body on the base.

6. The fan assembly of claim 5, comprising a biasing member for urging the interlocking members together to resist movement of the body from the tilted position.

7. The fan assembly of claim 1, wherein the stand comprises at least one stop member for inhibiting the movement of the body relative to the base beyond a fully tilted position.

8. The fan assembly of claim 7, wherein the stop member extends from the body for engaging part of the base when the body is in a fully tilted position.

9. The fan assembly of claim 1, wherein the base of the stand comprises a controller for controlling the fan assembly.

10. The fan assembly of claim 3, wherein the system for creating the air flow further comprises a diffuser located downstream from the impeller.

11. The fan assembly of claim 1, wherein the body comprises at least one air inlet through which the air is drawn into the fan assembly by the system for creating the air flow.

* * * * *